US006427606B1

(12) United States Patent
Klotz

(10) Patent No.: US 6,427,606 B1
(45) Date of Patent: Aug. 6, 2002

(54) SHELF ASSEMBLY

(76) Inventor: James L. Klotz, 6803 Roachtown Rd., Millstadt, IL (US) 62260

( * ) Notice: Subject to any disclaimer, the term of this patent is extended or adjusted under 35 U.S.C. 154(b) by 0 days.

(21) Appl. No.: 09/789,066

(22) Filed: Feb. 20, 2001

(51) Int. Cl.[7] ..... A47B 37/00
(52) U.S. Cl. ..... 108/42; 108/50.11; 211/119.003
(58) Field of Search ..... 108/50.02, 50.11, 108/50.17, 42; 211/90.01, 90.02, 90.03, 86.01, 135, 151, 119.009, 119.012, 119.004; 248/225.11, 223.31, 222.14

(56) References Cited

U.S. PATENT DOCUMENTS

| | | | | | |
|---|---|---|---|---|---|
| 1,064,843 | A | | 6/1913 | Marsh | 108/152 |
| 1,330,262 | A | | 2/1920 | Hallam | 248/223.31 |
| 2,590,793 | A | * | 3/1952 | Rigstad | 108/47 |
| 2,957,587 | A | | 10/1960 | Tobin | 108/27 |
| 3,943,859 | A | | 3/1976 | Boone | 108/50 |
| 4,181,382 | A | * | 1/1980 | Harvey | 211/90.02 |
| 4,339,045 | A | | 7/1982 | Bodin | 211/13 |
| 4,870,907 | A | | 10/1989 | McKee | 108/42 |
| 5,169,010 | A | * | 12/1992 | Fortner | 211/86 |
| 5,318,356 | A | | 6/1994 | Shelton | 312/223.1 |
| 5,577,819 | A | | 11/1996 | Olsen | 312/242 |
| 5,623,880 | A | | 4/1997 | Kuntz | 108/42 |
| 5,638,966 | A | * | 6/1997 | Kuntz | 211/153 |
| 6,026,605 | A | | 2/2000 | Tippett | 40/725 |
| 6,095,057 | A | * | 8/2000 | Corban | 108/42 |

* cited by examiner

*Primary Examiner*—Peter M. Cuomo
*Assistant Examiner*—Jerry A Anderson
(74) *Attorney, Agent, or Firm*—Grace J. Fishel

(57) ABSTRACT

A convenience shelf assembly for a wall having a holder mounted in a framework recessed in the wall. The holder is of a kind having a peripheral rim flush with the wall and attached to the framework with at least one threaded fastener. The convenience shelf assembly includes a shelf, a pair of spaced apart brackets attached to the shelf and a back wall having top, bottom and side edges. The side edges are connected to the brackets and the top edge is connected to the shelf. The back wall is wider along the top edge than the peripheral rim and has a thickness not substantially greater and preferably equal to or less than the thickness of the rim. The back wall has at least one slot dividing the back wall into sections, each of the slots opening from the bottom edge. The sections are adapted to straddle a portion of the holder recessed into the wall to prevent sideways tilting of the shelf assembly. The convenience shelf can be attached to the wall by loosening each of the threaded fasteners and slipping the back wall under the peripheral rim and then tightening each of the fasteners. The shelf assembly can be removed and the holder restored to its original condition by reversing the operation.

10 Claims, 3 Drawing Sheets

SHELF ASSEMBLY

BACKGROUND OF THE INVENTION

1. Field of the Invention

The present invention relates to a shelf assembly for attachment to an electrical outlet, electrical switch, toilet tissue holder or other similar holder mounted in a framework recessed in a wall without removing the holder to install the shelf assembly.

2. Brief Description of the Prior Art

Additional shelving is needed in many rooms, both at home and in the office. For those handy with tools, hanging a small shelf is not a problem, but many people lack tools or experience. In addition, if the premises are leased, the tenant may not be permitted to drive holes in the walls and, in any case, would prefer to install something that can be easily removed, without damaging the walls, and taken along when the lease ends.

BRIEF SUMMARY OF THE INVENTION

In view of the above, it is an object of the present invention to provide a small shelf assembly that can be easily installed and removed in bathrooms, kitchens, college dorm rooms, etc. It is another object to provide a shelf assembly that can be easily installed with a screwdriver to an existing electrical outlet, electrical switch, toilet tissue dispenser or other similar holder without removing the holder from the wall such that it is easy to restore the holder to its original condition when the shelf is removed. It is a further object to provide a shelf assembly that almost anybody can successfully install. Other objects and features of the invention will be in part apparent and in part pointed out hereinafter.

Features of the invention useful in accomplishing the above objects include a convenience shelf assembly to be attached to a wall having a holder mounted in a framework recessed in the wall. The holder is of a kind having a peripheral rim flush with the wall and attached to the framework with at least one threaded fastener. The convenience shelf assembly includes a shelf, a pair of spaced apart brackets attached to the shelf and a back wall having top, bottom and side edges. The side edges are connected to the brackets and the top edge is connected to the shelf. The back wall is wider along the top edge than the peripheral rim and has a thickness not substantially greater and preferably equal to or less than the thickness of the rim. The back wall has at least one slot dividing the back wall into sections, each of the slots opening from the bottom edge. The sections are adapted to straddle a portion of the holder recessed into the wall to prevent sideways tilting of the shelf assembly. The convenience shelf can be attached to the wall by loosening each of the threaded fasteners and slipping the back wall under the peripheral rim and then tightening each of the fasteners. The shelf assembly can be removed and the holder restored to its original condition by reversing the operation.

In a preferred embodiment, shelf and side brackets are notched for receipt of the back wall such that the back wall is not visible when the shelf is viewed from above or the brackets are viewed from the sides.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
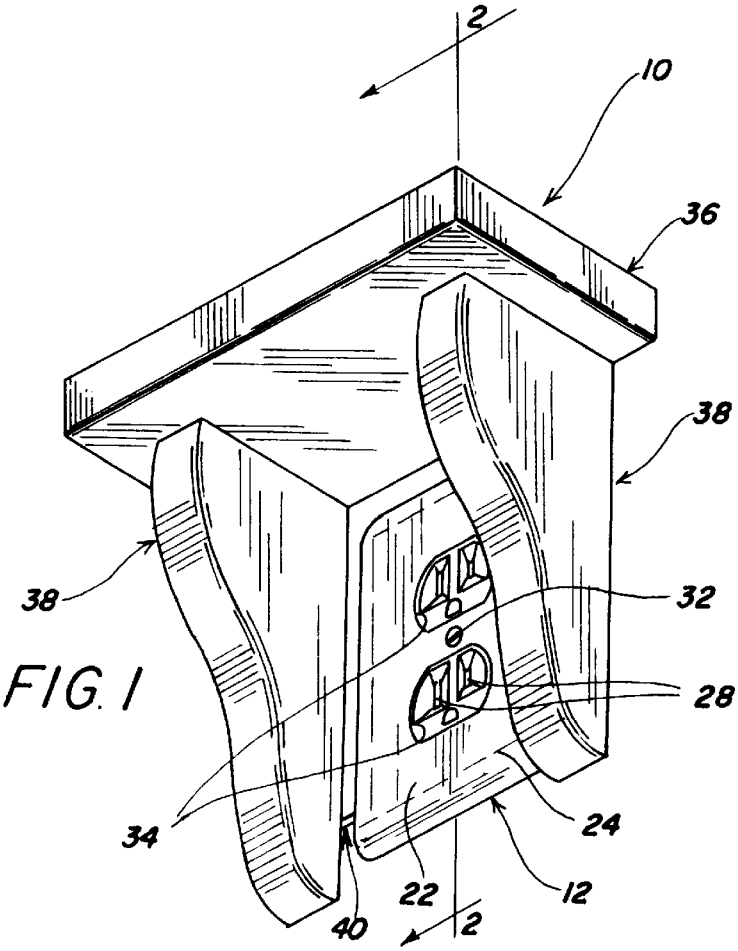
FIG. 1 is a perspective view of a shelf assembly in accordance with the present invention mounted on an electrical outlet.
Figure 2:
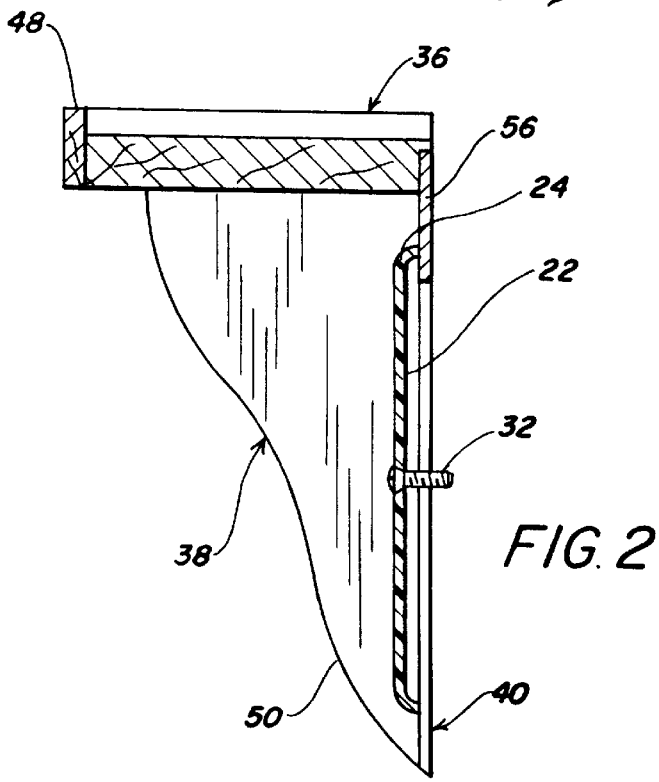
FIG. 2 is a cross-section taken along line 2—2 in FIG. 1.

Referring to the drawings more particularly by reference character, reference numeral 10 refers to a convenience shelf assembly in accordance with the present invention. Shelf assembly 10 is attached to a holder 12 mounted in a framework recessed in a wall 14. Holder 12 may take the form of an electric outlet as shown in FIGS. 1 and 3, an electric switch, a dispenser for toilet tissue as shown in FIG. 4, facial tissue or soap and so forth.

Figure 3:
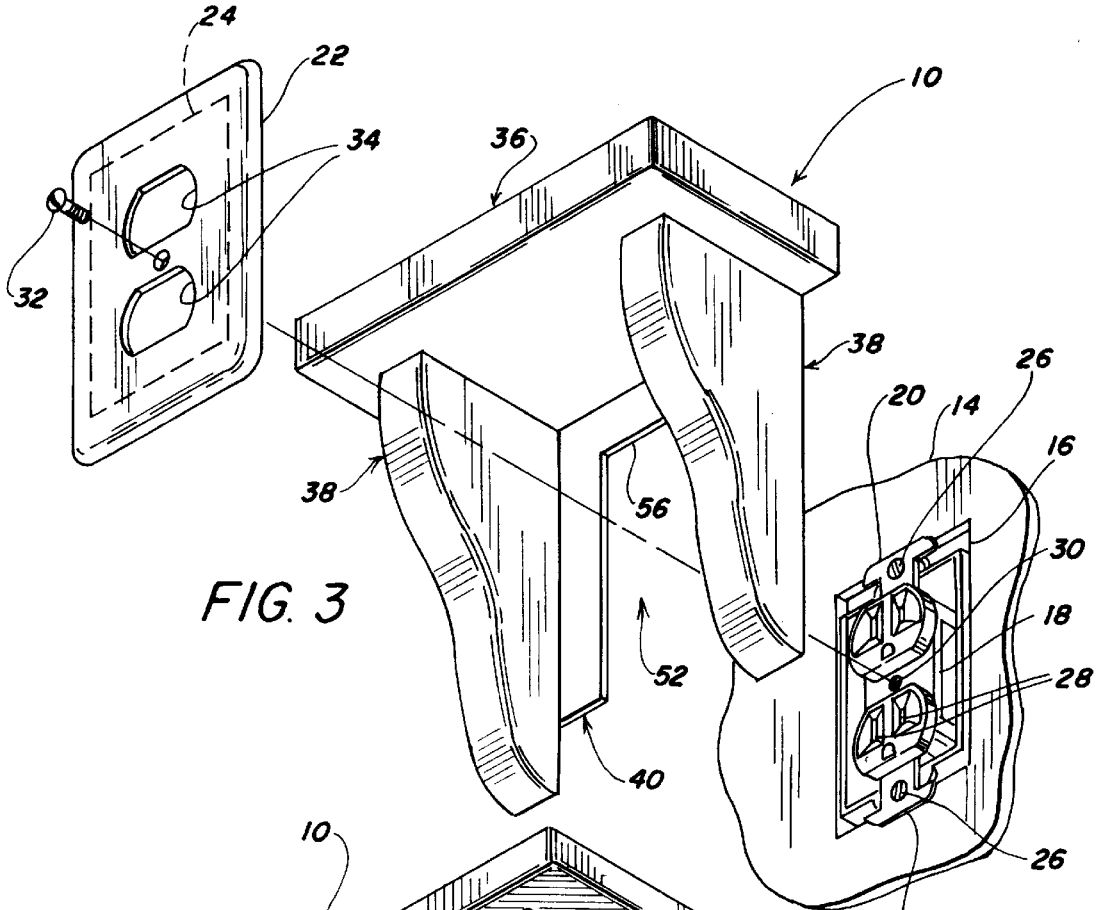
FIG. 3 is an exploded view of the shelf assembly mounted on the electrical outlet.
Figure 4:
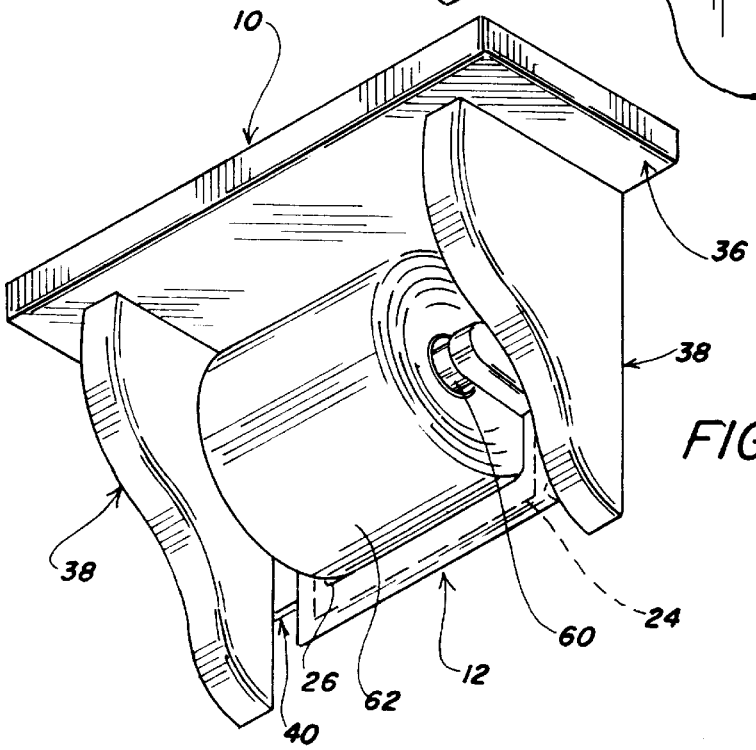
FIG. 4 is a perspective view of a shelf assembly in accordance with the present invention mounted on a toilet tissue holder.

With continued reference to FIGS. 1 and 3, holder 12 is illustrated as an electric outlet. It is believed that the particular form of outlet 12 is not important to the inventive concept herein described with the exception that it have a wiring box 16, an electrical receptacle 18 with attachment ears 20 and a cover plate 22 with a peripheral rim 24 flush with the wall. Wiring box 16 is recessed in wall 14 and electrical receptacle 18, illustrated in the drawings as a duplex electrical receptacle, is attached by attachment ears 20 to wiring box 16 by one or more threaded fasteners 26. Receptacle 18 has female receptacle contacts 28 and a threaded through-hole 30 for engaging a complementary threaded fastener 32 for fastening cover plate 22 over electrical receptacle 18. An aperture 34 is formed in cover plate 22 in front of each of female receptacle contacts 28 for accepting an ordinary electrical plug or the like. Peripheral rim 24 is flush with the wall when cover plate 22 is attached to electrical receptacle 18. Fasteners 26, 32 may be screws or the like.

Convenience shelf assembly 10 has a shelf 36, a pair of spaced apart brackets 38 and a back wall 40 having top 42, bottom 44 and side edges 46, respectively. Shelf 36 is mounted upon brackets 38 and may include a rim 48 around the front and sides forming a tray. An optional cover (not shown) may be provided. The lower ends of brackets 38 may be tapered 50 towards wall 14, for ease of access to electrical outlet 12, such that shelf assembly 10 does not interfere with normal use of the holder. Shelf 36 and brackets 38 may be formed of any suitable material, including but not limited to, wood, simulated wood such as press board, plastic, metal or any combination of the foregoing structural materials. Shelf 36 and brackets 38 may be unitary, integrally formed, or alternatively, pieced together in order to form the illustrated structure. Shelf 36 and brackets 38 may be solid throughout or formed with internal voids or hollow portions therein.

Back wall 40 is relatively thin and generally planar so that shelf assembly 10 can be fitted flat against wall 14. Shelf 36 and brackets 38 are generally perpendicular to back wall 40. While it is preferred that back wall 40 be of a generally rectangular configuration, those skilled in the art will appreciate that other shapes and configurations could be used. Top edge 42 is attached to shelf 36 and side edges 46 to brackets 38 with brackets 38 extending along back wall 40 from the bottom of shelf 36 toward or below bottom edge 44 of back wall 40.

With continuing reference to FIGS. 1 and 3, back wall 40 is wider along top edge 42 than peripheral rim 24 and has a thickness not substantially greater and preferably equal to or less than the thickness of cover plate 22 so that the cover plate is not noticeably spaced from the wall when shelf assembly 10 is installed. Back wall 40 has at least one slot 52, preferably rectangular, opening from bottom edge 44 and dividing back wall 40 into sections 54 with a strip 56 of back wall 40 remaining above slot 52. Slot 52 is sized such that when cover plate 22 is in front of slot 52, back wall 40 is under peripheral rim 24 of cover plate 22. Back wall 40 is preferably formed of a relatively stiff, electrically insulative plastic resin of suitable strength to support shelf assembly 10 and withstand normal wear. Where conductivity can be dealt with and additional strength is needed, back wall 40 may be formed of steel or other suitable material.

Figure 5:
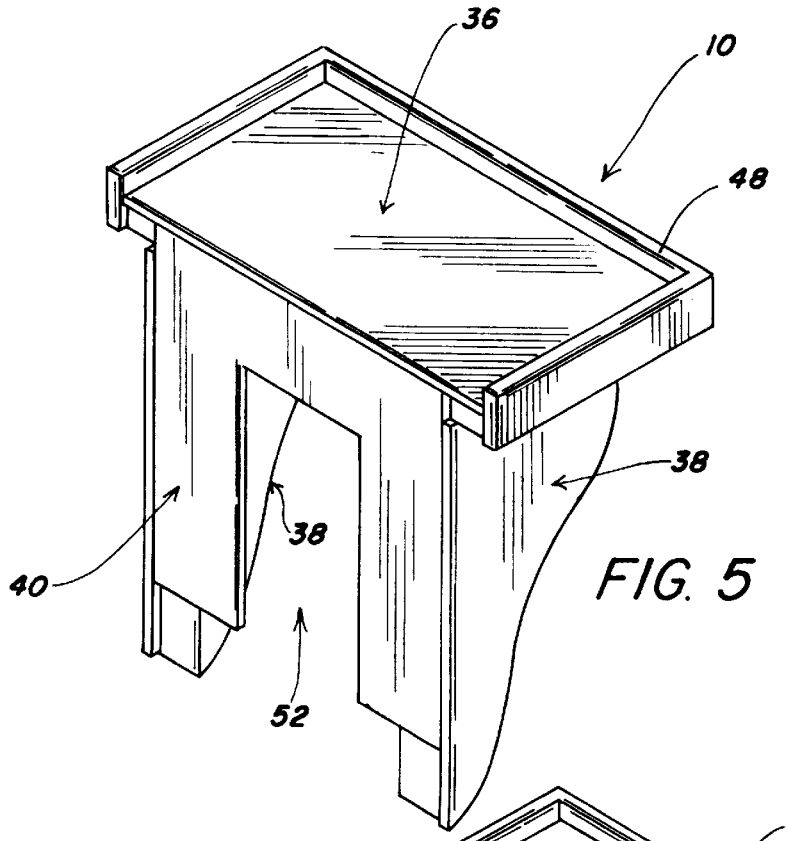
FIG. 5 is a perspective back view of the shelf assembly.
Figure 6:
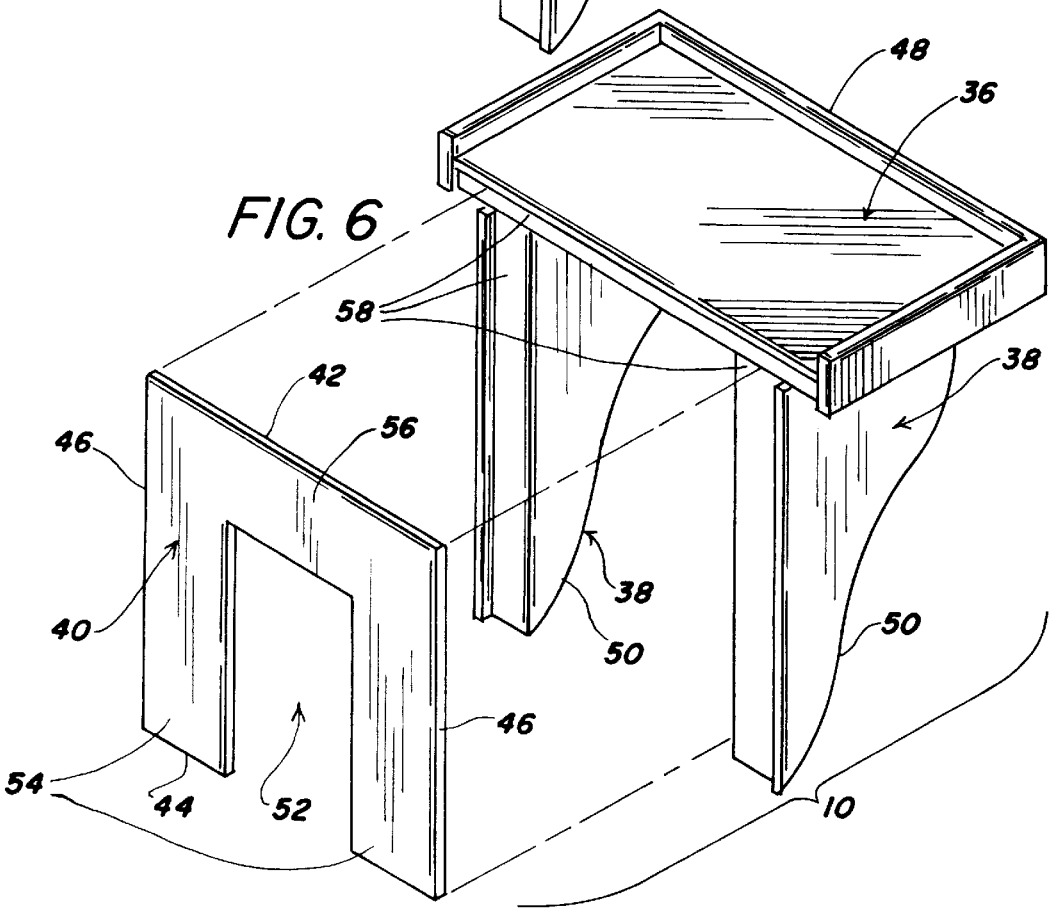
FIG. 6 is an exploded back view of the shelf assembly.

Turning now to FIGS. 5 and 6, it is seen that shelf 36 and brackets 38 are notched 58 for receipt of back wall 40 which is glued or otherwise attached to shelf 36 and brackets 38. When back wall 40 is in notch 58, back wall 40 cannot be seen when shelf 36 is viewed from above or when brackets 38 are viewed from the side. Back wall 40 in notch 58 also reinforces shelf assembly 10.

In use, fasteners 32 are loosened such that cover plate 22 is no longer flush with the wall. Back wall 40 of shelf assembly 10 is then slipped between the wall and cover plate 22, under peripheral rim 24, until downward movement is stopped by contact between strip 56 and attachment ears 20 on receptacle 18. Sections 54 of back wall 40 straddle receptacle 18 and prevent sideways tilting of shelf assembly 10. Shelf assembly 10 is then attached to the wall by re-tightening fasteners 32.

From the above, it is seen that shelf assembly 10 can be attached to outlet 12 without removing cover plate 22. The only tool needed is a screwdriver. It is also seen that shelf assembly 10 does not interfere with the use of outlet 12 as back wall 40 spaces shelf 36 and brackets 38 well above and to the sides of outlet 12. When a user removes the shelf assembly 10, outlet 12 is restored to its original condition.

A shelf assembly 10 for a double, triple, etc. outlet may be constructed and used along the lines discussed above. In similar manner, a shelf assembly for an electrical switch may be provided. Electrical switches, like electric outlet 12 discussed above, include a wiring box, switch mechanism with ears by means of which the switch mechanism can be attached to the wiring box and a cover plate with an aperture through which a switch actuator extends. A cover plate is attached to the switch mechanism with fasteners such as screws. As with outlet 12, shelf assembly 10 is slipped behind the peripheral rim of the switch cover plate until seated on the attachment ears of the electrical switches. The fasteners are then tightened.

A shelf assembly 10 may be provided for a toilet tissue holder 12 as shown in FIG. 4. Toilet tissue holder 12 is recessed into the wall and includes a roller 60 upon which a roll of toilet paper 62 may be suspended. Peripheral rim 24 of toilet tissue holder 12 is a flange which is mounted flush with the wall. Holder 12 is held in a framework recessed in the wall with fasteners 26. To mount shelf assembly 10 to toilet tissue holder 12, fasteners 26 are loosened such that a space forms between flange 24 and wall 14 into which back wall 40 may be slipped. Downward movement of shelf assembly 10 is stopped by contact with the body of toilet tissue holder 12 which is recessed in the wall. Shelf assembly 10 is attached to toilet tissue holder 12 by tightening fasteners 26.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A convenience shelf assembly for a wall having a holder mounted in a framework recessed in the wall, said holder having a peripheral rim flush with the wall and attached to the framework with at least one threaded fastener, said convenience shelf assembly comprising a shelf, a pair of spaced apart brackets attached to the shelf and a back wall having top, bottom and side edges, said side edges connected to the brackets and said top edge connected to the shelf, said back wall being wider along the top edge than the peripheral rim and having a thickness not substantially greater than the rim, said back wall having at least one slot dividing the back wall into sections, each of said slots opening from the bottom edge, said sections adapted to straddle a portion of the holder recessed into the wall to prevent sideways tilting of the shelf assembly, whereby said convenience shelf can be attached to the wall by loosening each of the threaded fasteners and slipping the back wall under the peripheral rim and then tightening each of the fasteners.

2. The shelf assembly of claim 1 wherein the back wall is received in a notch provided in the shelf and brackets such that the back wall cannot be seen when the shelf is viewed from above and the brackets are viewed from the sides.

3. The shelf assembly of claim 2 wherein the shelf and brackets are formed of wood, simulated wood or plastic and the back wall is formed of a plastic resin.

4. A convenience shelf assembly for a wall having a recessed holder for toilet tissue, facial tissue or soap mounted in a framework recessed therein, said holder having a peripheral flange flush with the wall and attached to the framework with at least one threaded fastener, said convenience shelf assembly comprising a shelf, a pair of spaced apart brackets attached to the shelf and a back wall having top, bottom and side edges, said side edges connected to the brackets and said top edge connected to the shelf, said back wall being wider along the top edge than the peripheral flange and having a thickness not substantially greater than the thickness of the flange, said back wall having a slot dividing the back wall into sections, said slot opening from the bottom edge, said sections adapted to straddle the recessed holder to prevent sideways tilting of the shelf assembly, whereby said convenience shelf can be attached to the wall by loosening each of the threaded fasteners and slipping the back wall under the peripheral flange and then tightening each of the fasteners.

5. The shelf assembly of claim 4 wherein the back wall is received in a notch provided in the shelf and brackets such that the back wall cannot be seen when the shelf is viewed from above and the brackets are viewed from the sides.

6. The shelf assembly of claim 5 wherein the shelf and brackets are formed of wood, simulated wood or plastic and the back wall is formed of a plastic resin.

7. A convenience shelf assembly for a wall having one or more electrical switches or receptacles with attachment ears, the switches or receptacles mounted by the attachment ears to a wiring box recessed in the wall, the wiring box having a cover plate with a peripheral rim flush with the wall and attached to each of the switches or receptacles with one or more threaded fasteners, said convenience shelf assembly comprising a shelf, a pair of spaced apart brackets attached to the shelf and a back wall having top, bottom and side edges, said side edges connected to the brackets and said top edge connected to the shelf, said back wall being wider along the top edge than the cover plate and having a thickness substantially equal to or less than the thickness of the cover plate, said back wall having at least one slot dividing the back wall into sections with a strip of back wall above the slot, each of said slots opening from the bottom edge, said sections adapted to straddle each of the electrical switches or receptacles to prevent sideways tilting of the shelf assembly with the strip resting on the attachment ears, whereby said convenience shelf can be attached to the wall by loosening each of the threaded fasteners and slipping the back wall under the cover plate and then tightening each of the fasteners.

8. The shelf assembly of claim 7 wherein the back wall is received in a notch provided in the shelf and brackets such that the back wall cannot be seen when the shelf is viewed from above and the brackets are viewed from the sides.

9. The shelf assembly of claim 8 wherein the shelf and brackets are formed of wood, simulated wood or plastic and the back wall is formed of a plastic resin.

10. The shelf assembly of claim 9 wherein the threaded fasteners are screws.

* * * * *